United States Patent [19]

DeFonzo

[11] Patent Number: 4,855,749

[45] Date of Patent: Aug. 8, 1989

[54] OPTO-ELECTRONIC VIVALDI TRANSCEIVER

[75] Inventor: Alfred P. DeFonzo, Amherst, Mass.

[73] Assignee: The United States of America as represented by the Secretary of the Air Force, Washington, D.C.

[21] Appl. No.: 160,736

[22] Filed: Feb. 26, 1988

[51] Int. Cl.[4] ..... H01Q 1/38

[52] U.S. Cl. ..... 343/767; 343/700 MS; 343/746

[58] Field of Search ..... 343/700 MS, 746, 747, 343/767, 770, 863; 455/327, 328; 332/116, 107 SL

[56] References Cited

U.S. PATENT DOCUMENTS

| | | | |
|---|---|---|---|
| 4,500,887 | 2/1985 | Nester | 343/700 MS |
| 4,541,120 | 9/1985 | Szabo | 331/107 SL |
| 4,751,513 | 6/1988 | Daryoush et al. | 343/700 MS |

OTHER PUBLICATIONS

Proceedings of the 9th European Microwave Conference, Microwave 79, Brighton, England (17-20 Sep. 1979), pp. 120-124.

S. M. Sze, Physics of Semiconductor Devices, Second Ed. p. 37-38 1981.

*Primary Examiner*—Rolf Hille

*Assistant Examiner*—Doris J. Johnson

*Attorney, Agent, or Firm*—William Stepanishen; Donald J. Singer

[57] ABSTRACT

A planar integrated opto-electronic transceiver apparatus having a pair of broadband tapered slot line antennas which are monolithically integrated on an ion implanted silicon on sapphire substrate. An optical pulse which is applied to the narrow slot of the transmitting antenna, generates an electromagnetic transient to the antenna aperture from which it is radiated to receiver slot line antenna. The received electromagnetic transient is detected at the narrow slot and is time resolved by an optical sampling signal.

10 Claims, 3 Drawing Sheets

OPTO-ELECTRONIC VIVALDI TRANSCEIVER

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to broadband tapered slot antennas, and in particular to a planar integrated opto-electronic transceiver.

There is considerable interest in high-performance mixers and receivers for the microwave, millimeter, and submillimeter-wave regions which will also be rugged, reliable, and can be mass produced at low cost. Applications range from radio astronomy to large military imaging systems. Since the packaging of existing high-performance transceivers is quite labor intensive, they are expensive and time consuming to produce. At frequencies above 100 GHz, conventional waveguide mixer circuits for transceiver units have become increasingly difficult to make, losses increase rapidly, and circuit elements are located at electrically long distances leading to large and uncontrolled parasitic elements. Monolithic integration allows circuit elements to be located electrically close so that circuit losses are reduced and parasitic elements can be controlled. Moreover, novel coupling and impedance-matching configurations are made possible by using the precision of photolithographically defined circuit elements. There clearly exists a need for high performance and efficient transmitting and receiving units which operate in the millimeter wave region.

In the prior art, the interest in optical generation and sampling of radiated electromagnetic transients has been demonstrated in a large variety of structures. The descriptions of these structures and results may be found in the following references:

G. Mourou, C. V. Stancampiano and D. Blumethl, "*Picosecond Microwave Pulse Generation*", Appl. Phys. Letter, 38, pp. 470–472 (1981).

D. H. Auston, and P. R. Smith, "*Generation and Detection of Waves by Picosecond Photoconductivity*", Appl. Phys. Lett., 43, pp 631–633 (1983).

D. H. Auston, K. P. Cheung, and P. R. Smith, "*Picosecond Photoconducting Hertzian Dipoles*", Appl. Phys. Lett., 45, pp. 284–286, (1984).

G. Mourou, C. C. Stancampiano, A. Antonetti, and A. Orszag, "*Picosecond Microwave Pulses Generated with a Subpicosecond Laser-Driven Semiconductor Switch*", Appl. Phys. Lett., pp 295–296 (1981).

M. G. Li, C. H. Lee, A. Caraglanian, E. A. Greene, C. Y. She, P. Polak-Dingles and A. Rosen, "Direct DC to RF Conversion by Impulse Excitation of a Resonant Cavity", pp 216–219, *Proceedings of the Topical Meeting on Picosecond Electronics and Optoelectronics*, Lake Tahoe, Nevada, Springer-Verlag (1985).

C. S. Chang, H. J. Rhec, Chi H. Lee, A. Rosen and H. Davis, "Kilovolt Sequence Waveform Generation by Picosecond Optoelectronic Switching in Silicon", pp 220–223, ibid.

R. Heidmann, T. H. Pfieffer and D. Jager, "*Optoelectronically Pulsed Slot-Line Antennas*" Electron Lett., 19, pp 316–317 (1983).

The present invention solves many of the prior art problems and provides an optically operated planar integrated transceiver apparatus.

SUMMARY OF THE INVENTION

The present invention utilizes a broadband tapered slot line antenna which is deposited on a silicon on sapphire substrate in which silicon has been ion implanted to reduce the free carrier lifetime. The slot is dc electrically biased. An optical pulse illuminates the narrow end of the slot and a current flows as a result of the photoconductivity of the silicon. This results in an electromagnetic transient that propagates down the slot toward the tapered antenna which radiates this transient. The tapered slot line antenna may be used in the reciprocal mode in which a radiating electromagnetic field is made incident on the slot and generates a transient biased voltage. The guided wave is propagated toward the narrow end of the slot and is detected and time resolved by photoconductively sampling the narrow end of the slot.

It is one object of the present invention, therefore, to provide an improved planar integrated opto-electronic transceiver apparatus.

It is another object of the invention to provide an improved planar integrated opto-electronic transceiver apparatus utilizing a linear tapered slot line antenna which is deposited on a silicon on sapphire substrate.

It is yet another object of the invention to provide an improved planar integrated opto-electronic transceiver apparatus utilizing a exponential tapered slot line antenna which is deposited on a silicon on saphhire substrate.

It is still another object of the invention to provide an improved planar integrated opto-electronic transceiver apparatus in which the silicon layer has been ion implanted to reduce the free carrier lifetime.

It is an even further object of the invention to provide an improved planar integrated opto-electronic transceiver apparatus in which an optical pulse illuminates the tapered slot line to generate an electromagnetic transient.

It is yet another object of the invention to provide an improved planar integrated opto-electronic transceiver apparatus in which a radiated electromagnetic field is made incident on a reciprocal antenna apparatus and is propagated toward the narrow end of the tapered slot line antenna.

It is still a further object of the invention to provide an improved planar integrated opto-electronic transceiver apparatus in which the propagated guided electromagnetic wave is time resolved by photoconductively sampling the receiver slot line.

These and other advantages, objects and features of the invention will become more apparent after considering the following description taken in conjunction with the illustrative embodiment in the accompanying drawings.

DESCRIPTION OF THE PREFERRED EMBODIMENT

Figure 1:
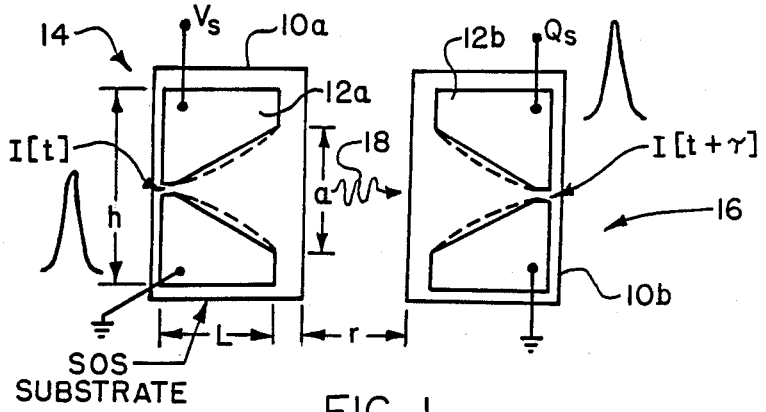
FIG. 1 is a schematic diagram of a matched planar integrated opto-electronic antenna transceiver apparatus according to the present invention.

Referring now to FIG. 1, there is shown a schematic diagram of a matched pair of slot line antennas which are arranged in a transceiver configuration. The transmitter and receiver units each comprise a silicon on sapphire substrate 10*a*, 10*b*. The silicon layer on the sapphire substrate may be epitaxially grown or deposited thereon by any other suitable method that is available. The silicon layer has been ion implanted with oxygen ions ($O^+$) to reduce the free carrier lifetime. A tapered broadband slot line antenna 12*a*, 12*b* has been deposited, respectively, on the surface of the silicon on sapphire substrates 10*a*, 10*b*. The slot line antenna may be formed by evaporating aluminum or any other suitable material on the surface of the substrate. The slot line antenna has a narrow slot at one end and either a linear (solid line) or exponentially (dashed line) taper at the other end (the antenna aperture). In the transceiver configuration, the large openings (antenna aperture) of the slot line antennas are facing each other. The transmitter unit 14 and the receiver unit 16 are both DC biased. An optical pulse, I(t) from a generating device, such as a dye laser, is applied to the narrow end of the slot line to create a current flow which is a result of the photoconductivity of the silicon. The current flow causes an electromagnetic transient to propagate the slot line to the tapered opening. The electromagnetic transient 18 is radiated from the tapered slot line antenna of the transmitter unit 14 towards the aperture of the tapered slot line antenna of the receiver unit 16. The electromagnetic transient 18 is guided by the tapered slot line antenna towards the narrow end of the slot line. The electromagnetic signal is detected and time resolved by photoconductive sampling at the narrow end of the receiver slot line antenna.

The present invention has been described as a broadband tapered slot antenna which has been monolithically integrated on ion damaged silicon-on-sapphire substrates and which are driven by picosecond photoconductivity to generate and detect millimeter waves. The time-dependent electromagnetic impulse response of the transceiver configuration that is shown in FIG. 1 is modeled by relating the antenna structure and the shape of the exciting pulse. The far-field response is observed to consist of a traveling-wave component and a standing-wave component, which is also predicted by the model of the transceiver.

The transceiver apparatus shown in FIG. 1 utilizes picosecond photoconductive transients that, when applied to the narrow slot line on silicon on sapphire substrate, will generate picosecond electromagnetic transient radiation. Recent studies of such transients from discontinuities in microstrip lines which are deposited on semiconductor substrates, indicate the potential for generating intense coherent pulses with durations less than 1 ps for practical and spectroscopic applications. The nature of the optically-induced electromagnetic transient radiation has been tested utilizing the circuit shown in FIG. 1. The results of a study of the picosecond impulse response of photoconductivity driven integrated microelectronic transmitter and receiver antennas fabricated on semiconductor substrates is set forth in the following descriptions and discussions.

The advantages of this configuration and apparatus can be summarized as follows. Unlike the radiating structure of the past, the antennas are designed for radiation of picosecond transients. A pump/probe sampling technique has been utilized in the design of the test circuit configuration, hence, the resulting measurements will be more accurate and it can be expected to observe high-frequency components. The photoconducting gap which drives the antenna is an integral part of the antenna structure. Thus, these structures are completely planar and can be monolithically fabricated on semiconductor substrates using conventional photolithographic techniques. In addition, the antennas are small in size and are consequently compatible with our integrated millimeter wave circuits.

The operating principle of the test circuit configuration which is illustrated in FIG. 1, is as follows. Identical transmitting and receiving antennas are fabricated on silicon-on-sapphire substrates. The photoconductive generator for the transmitting antenna is comprised of a short segment of aluminum slot line. The slot is dc biased and discharged photoconductively by illuminating the gap with a picosecond optical pulse. The discharge current pulse propagates into the antenna region where it dissipates radiatively. The radiated electromagnetic field which is emitted along the endfire direction of the antenna, propagates to the opposing antenna. The received field results in a transient bias voltage across the receiver slot. This voltage is sampled photoconductively by illuminating the semiconductor material within the slot with a picosecond optical pulse that is derived from the same source as the exciting pulse and delayed by a variable time $\gamma$. The time dependence of the receive signal is obtained by varying the time delay over the duration of the received transient.

The duration of the photoconductive transients is controlled by bombarding the silicon epilayer with energetic ions. In present test apparatus, the silicon bombarded was with 100 keV and 200 keV oxygen ($O^+$) ions to a dosage of $10^{15}$ $cm^{-2}$. Two antenna shapes were investigated. One was an exponentially tapered slot antenna. The other was a linearly tapered slot antenna. The overall length of the antennas was 2.9 mm, the width at the aperture was 1.9 mm and the slot width was 30 $\mu$m.

The optical pulses were obtained from a mode-locked dye laser in the standard three-mirror configuration. Mode locking was achieved by synchronously pumping an R6G dye jet with the frequency-doubled output of an actively mode-locked Nd:YAG laser operating at 1.06 μm. A standard second harmonic generation measurement technique was used to determine the pulse width of the mode-locked dye laser pulses. The minimum pulse width which was measured, was less than 2 ps and could be lengthened to 6 ps by adjusting the cavity parameters. The pulses were split using a variable delay line in a standard pump probe configuration. The transmitter slot was dc biased in the 10–40 V range. The time sampled receiver signal was passed through a low-frequency amplifier and plotted as a function of time delay between the pump and probe pulse on an x-y plotter.

Figure 2A:
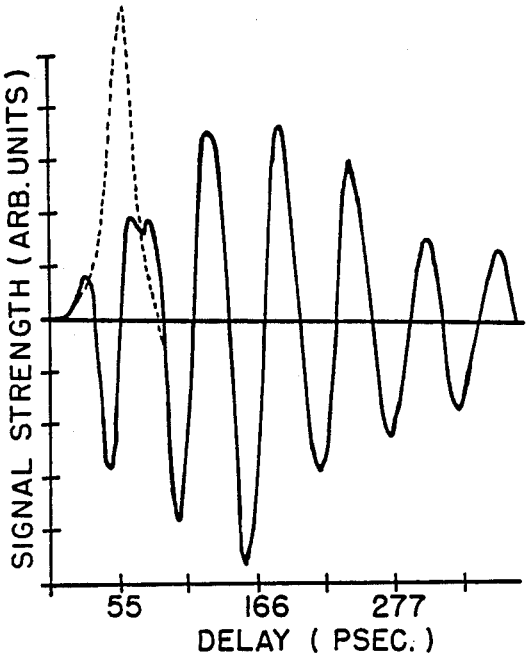
FIG. 2*a* is a graphical representation of the correlation trace of linearly tapered slot antenna with the transmitter and receiver on separate substrates.
Figure 2B:
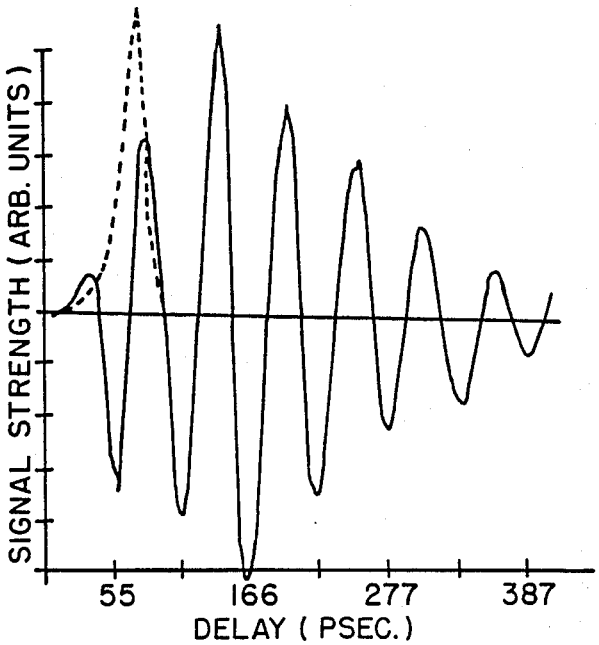
FIG. 2*b* is a graphical representation of the correlation trace of the exponential tapered slot antenna with transmitter and receiver on separate substrates.
Figure 2C:
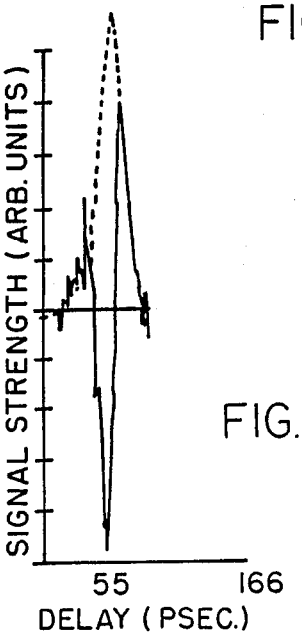
FIG. 2*c* is a graphical representation of the correlation trace of exponentially tapered slot antenna with transmitter and receiver on a common substrate showing the isolated traveling-wave component.
Figure 3A:
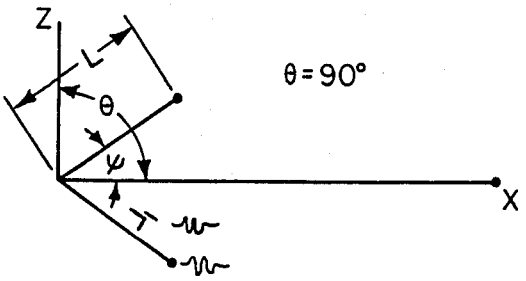
FIG. 3*a*–3*e* are graphical representations of the traveling-wave response function analysis.
Figure 3B:
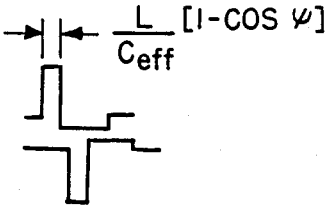
Figure 3C:
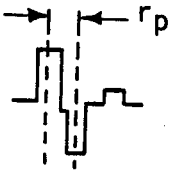
Figure 3D:
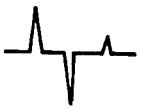
Figure 3E:
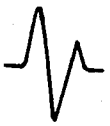

The measured correlation traces are shown in FIG. 2. FIGS. 2(*a*) and 2(*b*) show the results obtained when the tramsitting and receiving antennas were on different substrates separated by air gaps of approximately 1 and 0.7 cm, respectively. FIG. 2(*a*) is the result obtained from the linear tapered slot antenna. FIG. 2(*b*) is the result obtained for the exponentially tapered slot antenna. FIG. 2(*c*) shows the result obtained for an exponentially tapered transmitter receiver pair fabricated on common substrate with a separation distance of 3 mm. The dashed curve in each figure is the correlation trace independently obtained from a photoconductive cross correlation configuration commonly used to determine the duration of photoconductive transients.

The results for the air spaced antenna pairs are similar. Each correlation trace indicates the presence of a fast transient followed by a decaying oscillation. When the antennas are on the same substrate the oscillatory component is largely suppressed. Direct comparison of the photoconductive correlation with the antenna correlation indicates that initial transient is the derivative of the photoconductive transient.

The data were analyzed in terms of a time domain model of transient radiation from antennas and are based on concepts found in the antenna literature. The objective is to relate the main features in the data to the structure of the antenna and the shape of the drive pulse. Only the main elements of the model will be presented here. The details will be published elsewhere.

The analysis will begin by assuming that there are two distinct radiation mechanisms: a traveling-wave mechanism for the initial transient and a standing-wave mechanism for the longer time oscillatory radiation. The radiation received in the far field results from the transient and oscillatory photoinduced currents in the antenna. A geometric construction is used to simplify the analysis as shown in FIG. 3(*a*). First, we consider the traveling-wave radiation in the ideal dispersionless case for a step excitation. The excitation propagating from the source radiates continuously as a result of the accelerating charge at the step. The sign of the radiation reverses at time $t=L/C$ due to reflection from the end of the antenna. For an observer in the far field along the endfire direction, $\theta=90$ degrees, the retarded field will have the form as shown in FIG. 3(*b*). The response function for a square pulse is obtained by superimposing the step response with its inverse delayed by the pulse duration as shown in FIG. 3(*c*). If $L/c(1-\cos\phi) << \tau_p$ pulse width, it is possible to approximate the response function with delta functions as shown in FIG. 3(*d*). Convolving the response function with small reflection with a Gaussian pulse yields FIG. 3(*e*) which conforms with the analytical and numerical (moment method) results obtained for a "reflectionless" linear antenna.

Figure 4A:
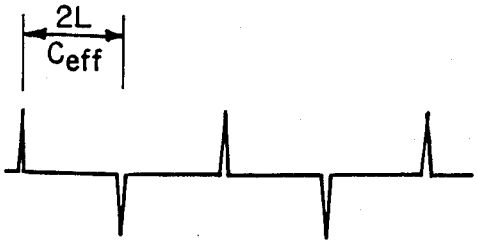
FIG. 4*a* is a graphical representation of the standing-wave response function for lossless case.
Figure 4B:
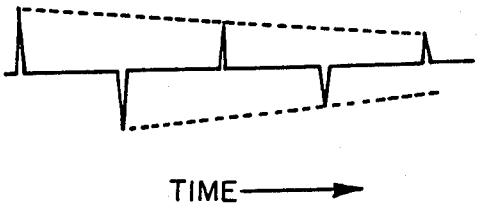
FIG. 4*b* is a graphical representation of the standing-wave response function with reflection coefficient r used to model losses.

The standing-wave contribution is a result of the acceleration of the charge due to reflection at the edge of the antenna. The broadside response function for an ideal dispersionless lossless delta function excitation is shown in FIG. 4(*a*). Reflection losses may be modeled with a reflection coefficient as shown in FIG. 4(*b*). Thus the total dispersionless response function has the form:

$$f(t) = B \sum_{0}^{n=2} A(n)\ (-1)^n \delta(t - nT_1) \tag{1}$$

traveling wave, $$f(t) = B \sum_{0}^{n} (-1)^n (1 - r)^2 r^{2n} \delta(t - nT_2) \tag{2}$$

standing wave, where $$A(n) = \begin{cases} A_1 & \text{for } n = 0,1 \\ mA_1 & \text{for } n = 2, m < 1, \text{ and,} \end{cases}$$

$T_1=\tau_P$=width of photoconductive pulse $A_1$ and B=constant proportional to light intensity, m=constant, $T_2=2L/C_{eff}$, 2L=length of antenna, and $C_{eff}$=effective velocity of light in material.

Figure 5A:
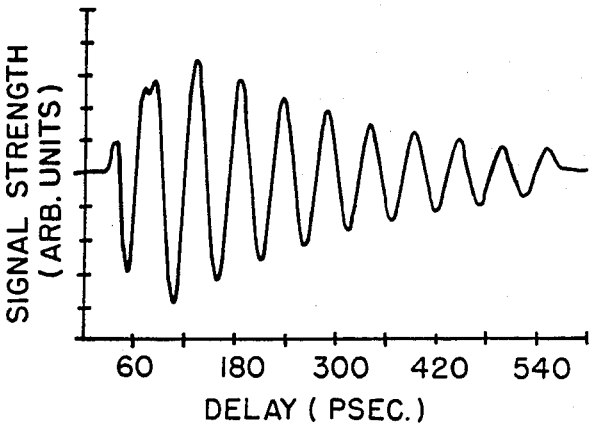
FIG. 5*a* is a graphical representation of the calculated response based on the theoretical model for a linearly tapered slot antenna.
Figure 5B:
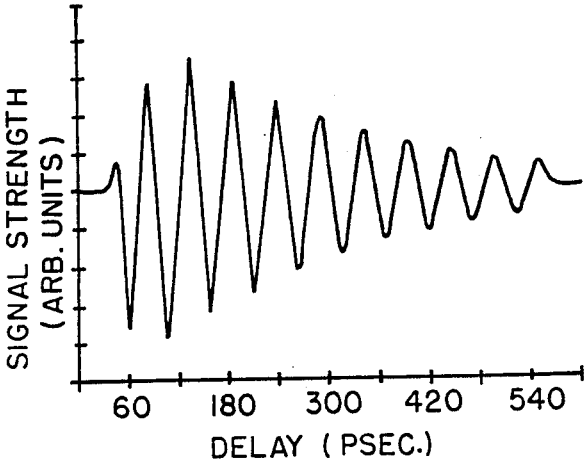
FIG. 5*b* is a graphical representation of the calculated response based on the theoretical model for an exponentially tapered slot antenna.
Figure 5C:
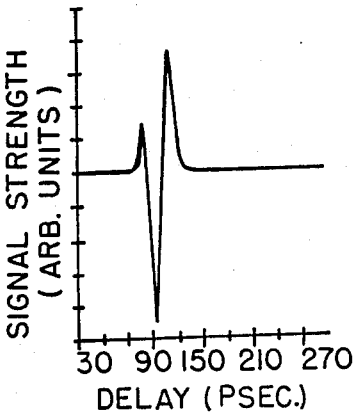
FIG. 5*c* is a graphical representation of the calculated response based on the theoretical model for a traveling-wave component.

The measured far-field traveling-wave response is predicted by twice convolving the response function of Equation (1) with a Gaussian function which represents the photoconductive pulse shape. Similarly, the measured far-field standing-wave response is predicted by twice covolving Equation (2) with the same photoconductive pulse. The total measured response is the sum of the traveling-wave response and the standing-wave responses delayed by the difference in propagation times in the antenna. The calculated response which is based on the above model, is shown in FIGS. 5(*a*), 5(*b*) and 5(*c*). The model yields excellent overall agreement with the data.

Reexamining the data in the light of the model, one obvious difference between the responses of the two antennas becomes apparent: the double hump in the initial portion of the linearly tapered slot antenna response. The model indicates the underlying origin of this feature is that the delay between the traveling-wave response and standing-wave response in this structure is greater than the corresponding delay in the exponentially tapered slot antenna. This suggests that the traveling wave in the former experiences greater wave guiding dispersions and, hence, travels at a slower velocity.

Thus, the present invention has demonstrated the operation of planar opto-electronic picosecond transceivers which are comprised of photoconductively driven tapered slot antennas. The far-field transmitter response is composed of two distinct components: a traveling-wave component and a standing-wave component. The response can be accurately modeled in the time domain using simple geometric constructs. The resulting response function may be used to predict the response to an arbitrary excitation waveform. Such antennas provide a unique opportunity for studying a variety of electromagnetic transient scattering problems as well as an entirely new method for characterizing antennas and guiding structures in the ultra-fast time domain.

Although the invention has been described with reference to a particular embodiment, it will be understood to those skilled in the art that the invention is capable of a variety of alternative embodiments within the spirit and scope of the appended claims.

What is claimed is:

1. A planar integrated opto-electronic transceiver apparatus comprising in combination:

a first silicon on sapphire substrate with a first tapered slot line antenna deposited on the surface of the silicon epilayer, said first slot line antenna having a narrow slot at one end and a large aperture at its other end, said first slot line antenna having a predetermined overall length, said first slot line antenna receiving a DC bias, said first slot line antenna receiving an optical pulse signal at said narrow slot which causes an electromagnetic transient to propagate down said first slot line antenna towards its aperture, said electromagnetic transient is radiated from said aperture of said first slot line antenna, and, a second silicon on sapphire substrate with a second tapered slot line antenna deposited on the surface of the silicon epilayer, said second slot line antenna having a narrow slot at one end and a large aperture at its other end, said second slot line antenna having a predetermined overall length, said second slot line antenna receiving a DC bias, said second slot line antenna receiving said electromagnetic transient at said aperture of said second slot line antenna, said electromagnetic transient is propagated down said second slot line antenna towards said narrow slot, said electromagnetic transient is detected and time resolved at said narrow slot by a photoconductive signal which is applied to said narrow slot.

2. A planar integrated opto-electronic transceiver apparatus as described in claim 1 wherein said silicon epilayer of said first and second silicon on sapphire substrate is ion implanted with energetic ions.

3. A planar integrated opto-electronic transceiver as described in claim 1 wherein said first and second slot line antennas have a linear taper.

4. A planar integrated opto-electronic transceiver as described in claim 1 wherein said first and second slot line antennas have an exponential taper.

5. A planar integrated opto-electronic transceiver as described in claim 1 wherein said DC bias on said first and second slot line antennas is in the range of 10–40 volts.

6. A planar integrated opto-electronic transceiver as described in claim 1 wherein said predetermined length of said first and second slot line antennas equals 2.9 mm, said narrow slot of said first and second slot line antennas has a width equal to 30 $\mu$m and said large aperture of said first and second antennas has a width equal to 1.9 mm.

7. A planar integrated opto-electronic transceiver as described in claim 2 wherein said energetic ions reduce the lifetimes of the free carrier in said silicon epilayer.

8. A planar integrated opto-electronic transceiver as described in claim 2 wherein said energetic ions have energy levels of 100 keV and 200 keV.

9. A planar integrated opto-electronic transceiver as described in claim 2 wherein said energetic ions are applied at a dosage level of $10^{15}$ $cm^{-2}$.

10. A planar integrated opto-electronic transceiver as described in claim 2 wherein said energetic ions are oxygen ions.

* * * * *